US010813458B2

(12) United States Patent
Moreschi

(10) Patent No.: US 10,813,458 B2
(45) Date of Patent: Oct. 27, 2020

(54) TILTING MECHANISM FOR CHAIRS

(71) Applicant: CO.FE.MO. INDUSTRIE S.R.L., Castegnato (IT)

(72) Inventor: Sergio Moreschi, Castegnato (IT)

(73) Assignee: CO.FE.MO. INDUSTRIE S.R.L., Castegnato (IT)

( * ) Notice: Subject to any disclaimer, the term of this patent is extended or adjusted under 35 U.S.C. 154(b) by 41 days.

(21) Appl. No.: 16/315,300

(22) PCT Filed: Jun. 15, 2017

(86) PCT No.: PCT/IB2017/053555
§ 371 (c)(1),
(2) Date: Jan. 4, 2019

(87) PCT Pub. No.: WO2018/007888
PCT Pub. Date: Jan. 11, 2018

(65) Prior Publication Data

US 2020/0178693 A1 Jun. 11, 2020

(30) Foreign Application Priority Data

Jul. 8, 2016 (IT) ..... 102016000071468

(51) Int. Cl.
*A47C 7/44* (2006.01)
*A47C 1/032* (2006.01)
(Continued)

(52) U.S. Cl.
CPC ..... *A47C 1/03266* (2013.01); *A47C 1/03272* (2013.01); *A47C 7/443* (2013.01);
(Continued)

(58) Field of Classification Search
CPC ..... A47C 1/03266; A47C 1/03255; A47C 1/03272; A47C 7/443; A47C 7/566; A47C 7/58
See application file for complete search history.

(56) References Cited

U.S. PATENT DOCUMENTS 2,859,799 A * 11/1958 Moore ..... A47C 1/03294 297/300.5
4,013,257 A * 3/1977 Paquette ..... A47C 1/03266 248/576
(Continued)

FOREIGN PATENT DOCUMENTS

EP 1258212 B1 7/2005
WO 2010/103554 A1 9/2010
(Continued)

OTHER PUBLICATIONS

International Search Report and Written Opinion of the International Searching Authority for International Patent Application No. PCT/IB2017/053555 dated Oct. 5, 2017, 8 pages.
(Continued)

*Primary Examiner* — Syed A Islam
(74) *Attorney, Agent, or Firm* — Pearne & Gordon LLP

(57) ABSTRACT

A tilting mechanism (1) for chairs includes a support frame (2), a structure (4) rotationally coupled to the support frame. An elastic system (80) is interposed between the support frame and the structure to counteract a reaction to the tilting of the structure from an at-rest position to a tilted position. An adjustment system (20) is capable of varying the reaction to the tilting. The elastic system (80) includes at least one elastic element (12) and a first and a second stop element (81, 82) fastened at respective longitudinal end portions of the elastic element, respectively. In the at-rest position, the first and second stop elements are in contact with each other, and the elastic element (12) is in a deformed configuration
(Continued)

and generates a residual elastic force that is at least partially released on the first and second stop elements.

11 Claims, 8 Drawing Sheets

(51) Int. Cl.
*A47C 7/56* (2006.01)
*A47C 7/58* (2006.01)

(52) U.S. Cl.
CPC ..... *A47C 7/566* (2013.01); *A47C 7/58* (2013.01); *A47C 1/03255* (2013.01)

(56) References Cited

U.S. PATENT DOCUMENTS

| | | | | |
|---|---|---|---|---|
| 4,832,402 | A * | 5/1989 | Zund | A47C 3/026 248/372.1 |
| 4,889,384 | A * | 12/1989 | Sulzer | A47C 3/026 297/303.4 |
| 4,948,198 | A | 8/1990 | Crossman et al. | |
| 5,026,117 | A * | 6/1991 | Faiks | A47C 3/026 267/131 |
| 5,108,065 | A | 4/1992 | Puerner | |
| 5,224,758 | A | 7/1993 | Takamatsu et al. | |
| 5,263,677 | A | 11/1993 | Puerner | |
| 5,375,912 | A * | 12/1994 | Stulik | A47C 3/026 297/302.4 |
| 6,033,020 | A | 3/2000 | Ito | |
| 6,120,096 | A | 9/2000 | Miotto | |
| 6,283,548 | B1 * | 9/2001 | Husemann | A47C 1/03255 297/300.1 |
| 6,382,724 | B1 | 5/2002 | Piretti | |
| 6,929,327 | B2 | 8/2005 | Piretti | |
| 7,766,426 | B2 * | 8/2010 | Meidan | A47C 1/03238 297/302.7 |
| 8,439,442 | B2 | 5/2013 | Highlander et al. | |
| 9,549,614 | B2 * | 1/2017 | Bock | A47C 1/03211 |
| 10,231,545 | B2 | 3/2019 | Moreschi | |
| 2001/0013569 | A1 | 8/2001 | Donati | |
| 2001/0050500 | A1 | 12/2001 | Piretti | |
| 2003/0001417 | A1 | 1/2003 | Moreschi | |
| 2007/0040432 | A1 | 2/2007 | Donati | |
| 2010/0308633 | A1 * | 12/2010 | Donati | A47C 1/03255 297/340 |
| 2011/0127820 | A1 | 6/2011 | Moreschi | |
| 2014/0014806 | A1 | 1/2014 | Yamamoto et al. | |

FOREIGN PATENT DOCUMENTS

| | | | |
|---|---|---|---|
| WO | 2010103554 | A1 | 9/2010 |
| WO | 2016166728 | A1 | 10/2016 |

OTHER PUBLICATIONS

European Patent Office, Office action issued on Application No. 17734485.0, dated Apr. 20, 2020, 3 pages.

International Search Report and Written Opinion of the International Searching Authority for International Patent Application No. PCT/IB2016/056079 dated Jan. 4, 2017, 8 pages.

* cited by examiner

TILTING MECHANISM FOR CHAIRS

This application is a National Stage Application of PCT/IB2017/053555, filed 15 Jun. 2017, which claims benefit of patent application Ser. No. 10/201,6000071468, filed 8 Jul. 2016 in Italy and which applications are incorporated herein by reference. To the extent appropriate, a claim of priority is made to each of the above-disclosed applications.

BACKGROUND OF THE INVENTION

The present invention concerns a tilting mechanism for chairs, comprising an adjustment system for adjusting the reaction to the tilting of a structure of a chair and which makes it possible to vary the entity of the reaction which the mechanism offers to a given tilt provided by the user.

There are known chairs, particularly for office use, that comprise a support frame constrained to means for resting the chair on the ground and at least one tilting structure for tilting with respect to the support frame. For example, this structure can consist of the support for the seat and/or the support for the backrest of the chair. In some embodiments, the seat support and the backrest support are rigidly constrained to each other and they tilt together; in other embodiments, the seat support and the backrest support both tilt with respect to the frame independently of each other or in a manner in which they are constrained to each other, but not rigidly constrained (in this case, they are referred to as "synchronized" mechanisms).

When the tilting structure tilts by pressure being exerted by the user, the chair counteracts with an elastic reaction which tends to bring the chair back into the at-rest configuration (no pressure being exerted). This reaction is typically obtained by means of an elastic element, for example at least one spring.

There are also known adjustment systems for adjusting the reaction to tilting which are capable of adjusting, according to the preferences of the user, the intensity of the reaction that the chair provides to a given tilting action, and which, in turn, must be balanced by the user.

Patent WO2010/103554A1 discloses a tilting mechanism for chairs that comprises an adjustment system for adjusting the reaction to the tilting action.

However, the Applicant has found that the prior-art tilting mechanisms equipped with an adjustment system are not convenient for the user as concerns the adjustment process, in that they require efforts to adjust the response to the tilting action, and/or they require prolonged adjustment procedures over time.

Once again, the Applicant holds that the prior-art mechanisms equipped with an adjustment system for adjusting the reaction to tilting do not offer an optimal response to tilting throughout the entire course of the tilting movement. In particular, the Applicant has realized that it is advantageous to limit variation of the entity of the reaction to tilting, starting from the at-rest position on through to the maximum tilting position, so as to prevent the user from experiencing excessive dynamics in the response of the chair (for example, by proving to be too "light" for low tilting and/or too "hard" for high tilting).

SUMMARY OF THE INVENTION

An aim of the present invention is to develop a tilting mechanism for chairs, said tilting mechanism comprising an adjustment system for adjusting the reaction to titling and that is capable of varying the entity of the reaction that the system offers to a given tilt provided by the user, which can resolve one or more of the issues described above One or more of these aims are realized by a tilting mechanism for chairs in accordance with the appended claims and/or having the following characteristics.

According to a first aspect, the invention concerns a tilting mechanism for chairs, said tilting mechanism comprising a support frame apt for being mounted on a stem of a chair, a structure coupled to said support frame so that it can rotate about a first axis, and an elastic system interposed between said support frame and said structure and configured to counteract a reaction to the tilting of said structure about said first axis from an at-rest position, in the absence of tilting forces, to a tilted position, said response generating a reaction moment acting upon said structure with respect to the first axis.

The tilting mechanism comprises an adjustment system capable of varying said reaction moment for a given tilting.

The elastic system preferably comprises at least one elastic element, having two fastening ends and a first and a second stop element fastened at respective longitudinal end portions of said elastic element, respectively.

Preferably, in the at-rest position, said first and second stop elements are in contact with each other, and said elastic element is in a deformed configuration and generates a residual elastic force which is at least partially released on the first and second stop elements, pushing them one against the other.

According to the Applicant, the fact that in the at-rest position the elastic element is in a deformed configuration so as to generate a residual elastic force, which, however, is at least partially released on the first and second stop elements, for they are in contact with each other, enables to user to easily adjust the adjustment system in the at-rest position. In fact, for this adjustment, it is typically necessary to move one or more components of the adjustment system (for example, it is necessary to move a pin for the purpose of varying the actual moment arm of the elastic force of the elastic element with respect to the first axis of rotation), and in order for this to be easily performed, it is advantageous that this (these) component(s) not be subjected to residual forces generated by the elastic element or that it (they) be subjected to low residual forces. At the same time, the fact indicated above leads to the fact that in order to start the tilting process of the structure from the at-rest position, the two stop elements must be detached from each other, overcoming the fraction of the residual elastic force that keeps them pushed against each other.

This contributes to giving the structure stability in the at-rest position.

Moreover, this fact gives the elastic system a residual reaction moment, which develops only in the tilted positions, and which makes the reaction of the mechanism more uniform along the entire possible course of the tilting movement, as shall be explained in further detail below.

The present invention can offer one or more of the following preferred characteristics. Preferably, said residual elastic force is (substantially) completely released on the first and second stop elements. In this manner, in the at-rest position, the elastic element does not generate any elastic force between its two fastening ends.

Said fastening ends are preferably fastened to a first and a second fastening element, respectively, wherein the first fastening element is fastened to said support frame and the second fastening element is directly or indirectly fastened to said structure or to said adjustment system. Preferably, each fastening element has a first portion at which a respective fastening end is fastened and a second portion, wherein the second portion of the first fastening element is fastened to said support frame and the second portion of the second fastening element is (movably) directly or indirectly fastened to said structure or to said adjustment system.

Said first and second stop elements are preferably solidly constrained to said first and second fastening elements, respectively, and more preferably they coincide with said first and second fastening elements. In this manner, the mechanism is simplified in terms of its structure and/or assembly. However, the present invention also encompasses solutions in which the stop elements are distinct and separate from the fastening elements and fastened to the elastic element in positions interposed between the two fastening elements.

Preferably, in the at-rest position, the first and second stop elements are in contact with each other at portions thereof that are inside said elastic element. The stop elements thus prove be of small dimensions. However, the present invention also encompasses solutions in which the stop elements are external to the elastic element, for example at least in the area in which they are in contact with each other.

Said structure preferably has a maximum tilting position beyond which said structure cannot tilt any further, wherein said elastic element exerts a maximum elastic force at said maximum tilting position.

Said residual elastic force is preferably greater than or equal to 5%, more preferably greater than or equal to 10%, and even more preferably greater than or equal to 20% or 30%, of said maximum elastic force. In this manner, the overall variation of the elastic force during the entire tilting range proves to be limited.

Preferably, at least one of the stop elements comprises a spacer on the side facing the other stop element. Assembly of the mechanism is thus simplified and, in the design stage, by varying the length of the spacer, it is possible to adjust the residual elastic force by adjusting the deformation of the elastic element at the point of contact between the stop elements.

Preferably, said structure has a lower stop position in which the structure directly or indirectly abuts against said support frame. The structure also typically has an upper stop position (in which the structure directly or indirectly abuts against said support frame), which determines the maximum tilting position.

Preferably, at said lower stop position, said first and second stop elements are in contact with each other. In this manner, the mechanical abutment of the structure against the support frame withstands possible stress on the structure having a direction opposite the tilting direction, without subjecting the stop elements to excessive stress as they would be pushed one against the other by such stresses, in addition to the normal push exerted by the above-mentioned (fraction of) residual elastic force.

The elastic system preferably comprises an additional elastic element configured to contribute to said reaction moment. Note that one of the advantages of the present invention is that even in the absence of the additional elastic element, the elastic system can exert a residual push that keeps the structure stopped in the at-rest position, while at the same time keeping the adjustment system in a completely unloaded state (or almost completely unloaded state). For example, this occurs when the two stop elements also act as the abutment for the lower stop of the structure (in this case, they are preferably structurally dimensioned in such a manner as to be able to withstand the push counter to the tilting movement, said push being exerted on the structure).

Said additional elastic element is preferably configured so as to maintain, in said at-rest position, a respective deformation that generates a further residual elastic force (for example it is slightly tensioned). In addition to increasing the dynamics of the reaction to the tilting, the additional elastic element offers the advantage that in the at-rest position it can keep the structure pushed in abutment against the lower stop. In this case, the position of contact between the stop elements of the elastic element is made to coincide with the position of the lower stop, also taking into account clearances and/or elastic deformations of the overall mechanism. Advantageously, in the at-rest state, the structure is thus kept stopped against the support frame by the additional elastic element, until the application of a tilting force that is sufficiently strong to overcome the further residual reaction force and, immediately after, the above-mentioned residual reaction force.

Said deformed configuration of said elastic element and/or of said additional elastic element in the at-rest position is preferably an elongated configuration. In this manner, the elastic element and/or said additional elastic element work(s) in a tensioned state and the overall mechanism proves to the simple and compact. However, the present invention also encompasses solutions in which the elastic element and/or said additional elastic element work(s) in a compressed state.

The elastic element and/or said additional elastic element is preferably a coil spring. In this manner, a simple, lightweight and durable mechanism is realized. However, the present invention also encompasses solutions in which the elastic element and/or said additional elastic element consists of an elastomeric element, or a pneumatic or hydraulic cylinder or similar devices.

Preferably, each stop element has a cylindrical external surface provided with a thread having a pitch compatible with a respective pitch of said coils, wherein each longitudinal end portion, or each fastening end, of said spring is screwed externally to the respective cylindrical external surface of a respective stop element. In this manner, the spring is fastened to the stop elements simply and securely.

The adjustment system preferably comprises a pin that is movably coupled to said structure so as to enable the distance between the pin and the first axis to be varied, wherein during the tilting process, said elastic element generates an elastic reaction force, which is transmitted to said structure by means of said pin.

The adjustment system preferably comprises a movement system for moving said pin so as to vary said distance between said pin and said first axis.

In accordance with a further aspect, the present invention concerns a chair that comprises the tilting mechanism having one or more of the preceding characteristics.

The chair preferably comprises means for resting it on the ground, which for example comprise a stem, said support frame being rigidly mounted on said stem.

The chair preferably comprises a seat for a user and/or a backrest. For example, said structure can be solidly constrained to the seat and/or backrest.

The characteristics and advantages of the present invention shall be clarified further in the following detailed description of some embodiments, which are presented as non-limiting examples of the present invention.

BRIEF DESCRIPTION OF THE DRAWINGS

The following detailed description refers to the attached figures, of which.

DETAIL DESCRIPTION OF THE PREFERRED EMBODIMENTS

Figure 1:
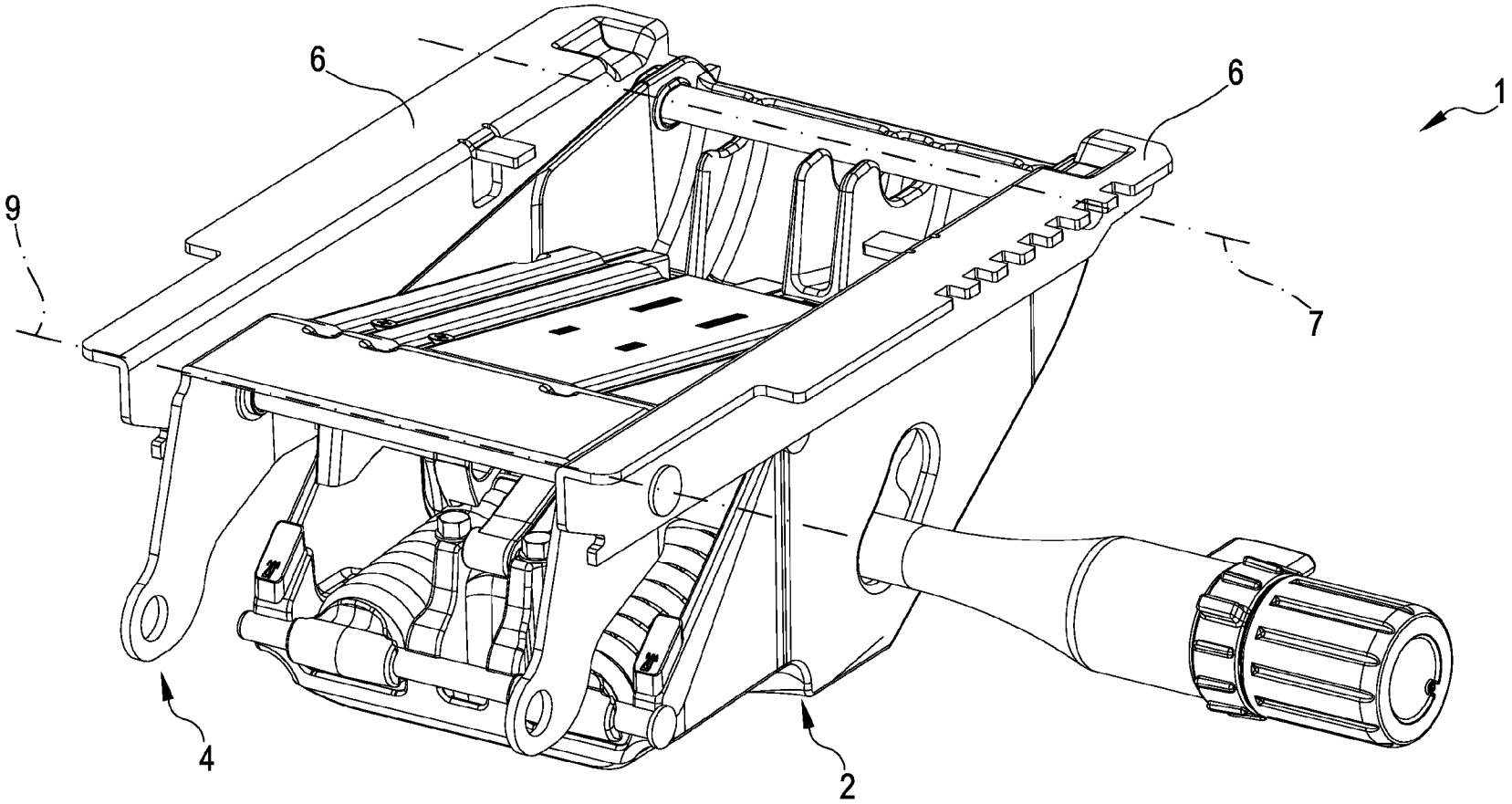
FIG. 1 is a perspective view of an example embodiment of the tilting mechanism of the present invention.
Figure 2:
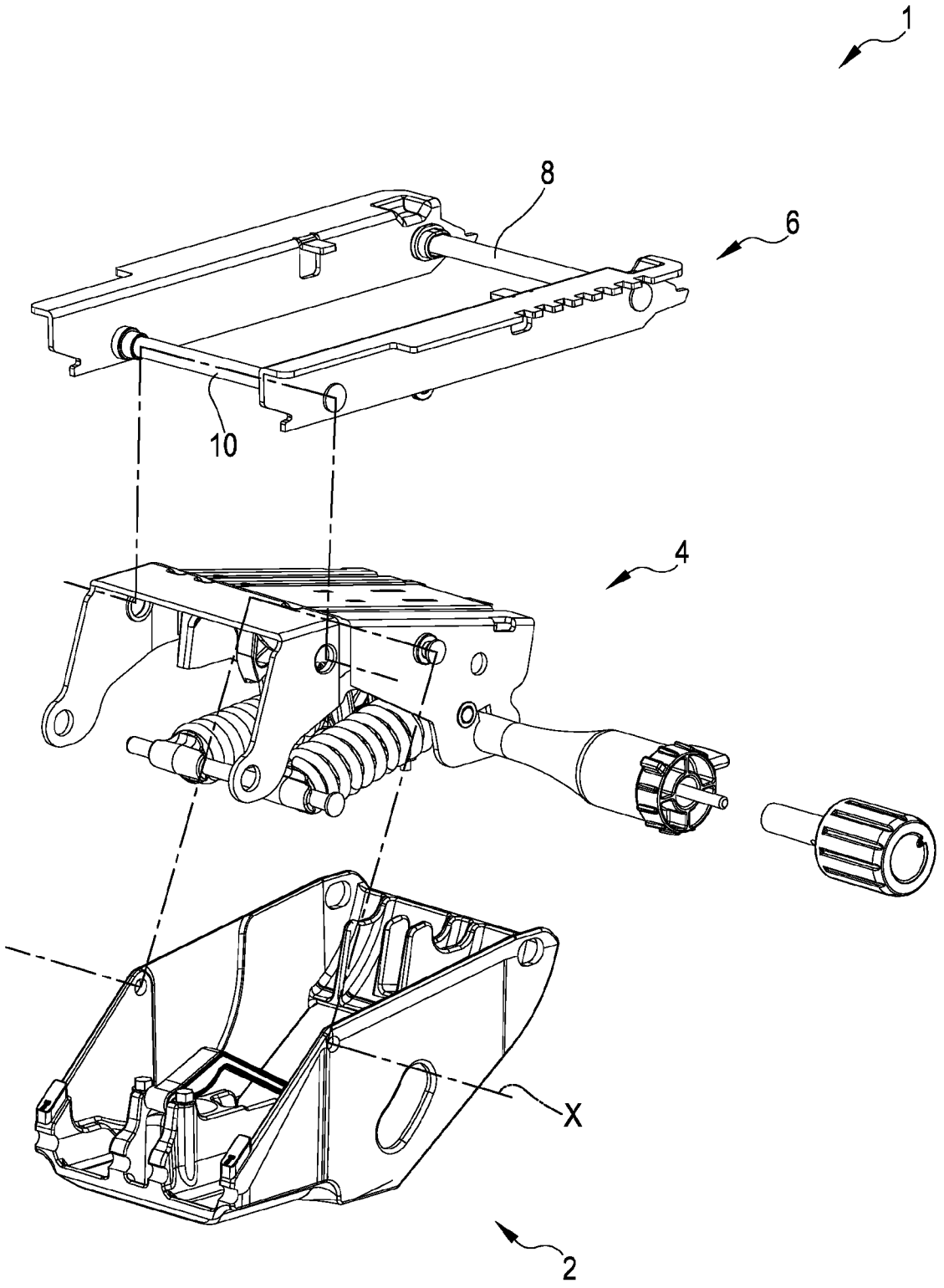
FIGS. 2-5 are views of the embodiment appearing in FIG. 1, with several parts be progressively removed and/or shown in an exploded view.
Figure 3:
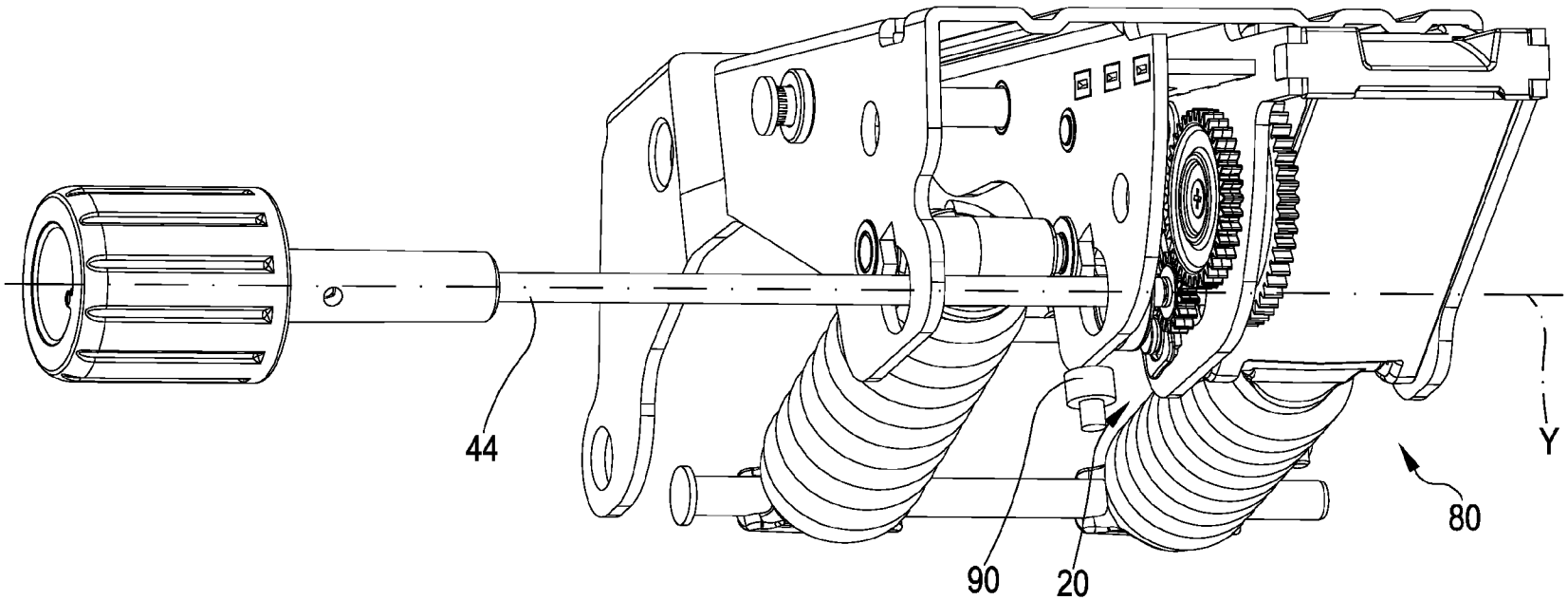
Figure 4:
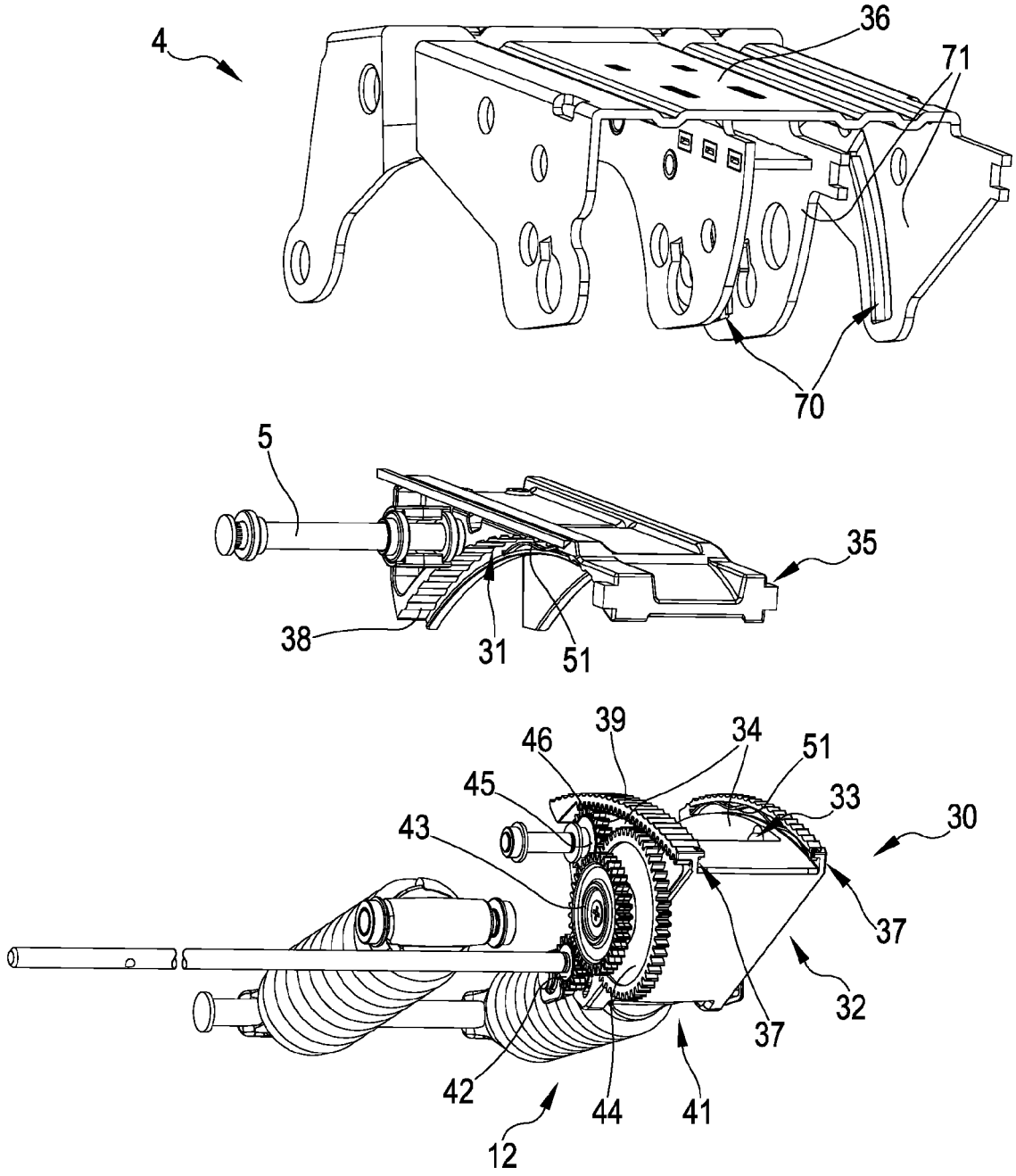

A tilting mechanism 1 for chairs is shown in the figures according to a possible embodiment of the present invention.

In FIGS. 1-6, the mechanism is shown in the at-rest state (absence of titling forces) and in a first configuration corresponding to a maximum hardness adjustment, as shall be described in further detail herein below.

The tilting mechanism 1 comprises a support frame 2 that is designed to be associated with means (unillustrated) for resting a chair on the ground. For example, a stem can engage a cavity in the support frame, with which adjustment mechanisms for adjusting the position (height) of the frame along the stem are associated; the latter are not described in further detail as they are for example of a known type.

The tilting mechanism comprises a structure 4 that is pivotably coupled to the support frame so that it can rotate about a first axis X, and preferably solidly constrained to the frame 2. For example, a pin 5, which is coaxial with the first axis X, is mounted on the frame (e.g. by means of suitable bushings) and passes through (by means of suitable through holes) the structure 4 (as well as through all the elements it encounters) for the entire length thereof.

In the example shown, the structure 4 is by way of example a support for a backrest (unillustrated) of the chair. In this example, the mechanism 1 also comprises a support 6 for a seat (unillustrated) of the chair, in the form of a pair of shaped bars. The support 6 for the seat is pivotably coupled to the support frame so that it can rotate about a respective axis 7. For example, a pin 8, which is coaxial with the axis 7, is mounted on the support 6 and passes through the support frame 2 at a pair of suitable bushings that also function as spacers. In the example shown, the support 4 for the backrest and the support 6 for the seat are articulated with respect to each other so as to tilt in synchrony with a predetermined relation of movement. For this purpose, the support 6 for the seat is also pivotably coupled to the structure 4 so that it can rotate about a respective axis 9. For example, a pin 10, which is coaxial with the axis 9, is mounted on the support 6 for the seat and passes through the support 4 for the backrest at suitable bushings. For the purpose of enabling articulation between the seat support 6 and the backrest support 4, the bushings for the pin 8 are rectilinear slotted bushings.

However, the present invention also comprises mechanisms (unillustrated) in which the structure 4 is a support for a seat, or in which the seat support and the backrest support are rigidly constrained to each other and they tilt together, or in which the seat support and the backrest support both tilt with respect to the support frame independently of each other or in which the relation between the movement of the backrest support and the movement of the seat support is adjustable.

The mechanism 1 comprises an elastic system 80 comprising an elastic element 12 interposed between said support frame 2 and said structure 4 and configured to counteract an elastic reaction to the tilting of said structure about said first axis X from an at-rest position (shown for example in FIGS. 1-6), in the absence of tilting forces, to a tilted position (shown by way of example in FIG. 7, which shows the maximum tilting position), the elastic response generating a reaction moment acting upon the structure 4 with respect to the first axis X.

The tilting mechanism 1 comprises an adjustment system 20 for adjusting the reaction to tilting and that is capable of varying said reaction moment for a given tilting.

The adjustment system 20 preferably comprises a pin 21 that is movably coupled (e.g. by means of suitable square bushings 22) to said structure 4 so as to enable the distance between the pin 21 and the first axis X to be varied, wherein the elastic element 12 directly abuts on the pin 21 so that the elastic force acting on the structure is directed along the main direction of extension 50 of the elastic element 12.

Advantageously, the adjustment system 20 comprises a movement system 30 for moving the pin 21 so as to vary the distance between the pin and the first axis X.

The movement system 30 preferably comprises a guide 31 that is solidly constrained to the structure 4 and a movement member 32 that is slidably engaged in the guide, wherein the movement member engages the pin 21 in such a manner that when the movement member 32 slides in the guide, the movement member moves the pin 21.

Preferably, the guide 31 is curvilinear in extension, more preferably along a first arc of a circle with the concavity facing the movement member and the pin 21, and lying in a plane perpendicular to the first axis X. In an alternative embodiment, which is not illustrated here, the guide can be rectilinear in extension.

The movement member 32 preferably has a pair of first slots 33 that are symmetrically opposite each other (preferably fashioned on two opposite walls 34 of the member 32, respectively) through which the pin 21 passes transversely (typically perpendicularly) to a respective principal plane of extension (parallel to the plane of FIG. 6) of the first slots 33. Preferably, the movement member 32 is configured to move the pin 21 along the principal line of extension 49 (lying on said respective principal plane of extension) of the first slots 33 at the sliding point in the guide.

Preferably, each first slot 33 in the section on the respective principal plane of extension is toothed along the respective principal line of extension, the section of each first slot being made up of a discrete series (fifteen in the example) of seats 40 for the pin (having a substantially circular envelope), each seat being separated from the next seat(s) by at least one ridge 48. In the example, the ridge is cuspidal in shape, but it can be of any shape, particularly convex. For example, the first slots 33 have at least one portion of the inner surface 47 (which can be the upper or lower surface or both or a portion thereof) that is undulated so as to create the series of cusps 48 and seats 40. By way of example, the inner surface of the first slots that is opposite the undulated surface 47 is smooth so as to facilitate movement of the pin 21. Preferably, the opposite surface is elastically deformable (for example, owing to a series of weight-relief cavities 46). In the embodiment shown in the figures, the principal line of extension 49 of the first slots 33 is practically in the form of an arc of the circle.

Preferably, the movement system comprises a guide body 35 on which the guide 31 is afforded, the guide body being rigidly connected to the structure 4, preferably at an upper wall 36 of the structure.

Preferably, the movement member 32 has an engagement portion 37 that is complementarily shaped to the guide 31. In the example shown, the guide 31 is made up of two tracks belonging to the guide body 35 and that are symmetrically opposite each other and the engagement portion 37 is made up of two opposite rib-like structures belonging to the movement member; the rib-like structures engage the respective tracks and extend along said first arc of a circle.

Preferably, at least one of the contact surfaces between the guide 31 and the movement member 32 is toothed along the respective direction of extension, these teeth typically corresponding to the teeth of the first slots 33. For example, the guide body 35 has a series of ridges 38 at each track that engage a series of seats 39 (the distance between two contiguous ridges being twice the distance between two contiguous seats) which are afforded on the movement member and have positions corresponding to the above-mentioned seats 40 of the first slots. Suitable elastic sheets 51 keep the surface with the ridges 38 and the surface with the seats 39 pushed one against the other.

The movement system 30 preferably comprises a control rod 44 solidly constrained to the structure 4 and extending along a second axis Y (preferably parallel to the first axis X), and a gear system 41 interposed between said control rod and said movement member, for the purpose of converting the rotational motion of said rod into movement of said movement member along said guide 31.

The gear system preferably comprises a first wheel 42 fitted onto said rod and meshed with a second wheel 43 that is rotationally fixed to the structure 4. A third wheel 44 is coaxial with and solidly constrained to the second wheel to receive motion from the second wheel and it is meshed with a fourth wheel 45, which, in turn, is meshed with a rack 46 afforded on the movement member 32. Preferably, all the wheels have axes of rotation parallel to each other and parallel to the first axis X. In the example shown, the wheels are toothed wheels and they are meshed with each other in series. However, (though unillustrated) the wheels can be smooth and transmit the rotational motion by contact friction and/or the wheels can be meshed by means of belts or chains.

Note that in the example shown the control rod advantageously completes a rotation of about one third of a revolution so as to pass between the configurations of minimum and maximum hardness.

According to the invention, a first and a second stop element 81, 82 are fastened at respective longitudinal end portions of the elastic element 12, respectively.

In the example shown, the first and the second stop elements 81, 82 are fastened at two fastening ends 12*a*, 12*b* of the elastic element 12 and coincide with a first and a second fastening element 81', 82', respectively.

Preferably, each fastening element has a first portion 81*a*, 82*a* at which a respective fastening end is fastened and a second portion 81*b*, 82*b*, where the second portion 81*b* of the first fastening element is fastened to the support frame (by means of a rod) and the second portion 82*b* of the second fastening element 82 is fastened to the pin 21 and thus to the adjustment system 20.

Preferably, in the at-rest position (see FIG. 6 for example), the first and second stop elements 81, 82 are in contact with each other and the elastic element is in a deformed configuration and generates a residual elastic force which is at least partially released on the first and second stop elements, pushing them one against the other. In the example shown, where the stop elements coincide with the fastening elements (and thus act upon the fastening ends of the spring 12), the entire residual elastic force is completely released on the first and second stop elements, so that in the at-rest position no elastic force is acting between the pin 21 and the frame 2.

By way of example, in the at-rest position (FIG. 6), the first and second stop elements are in contact with each other at portions thereof that are inside the elastic element.

By way of example, the second stop element 82 comprises a spacer 83 on the side facing the first stop element 81, the spacer 83 being fastened to the rest of the second stop element 82 by means of a screw.

Figure 5:
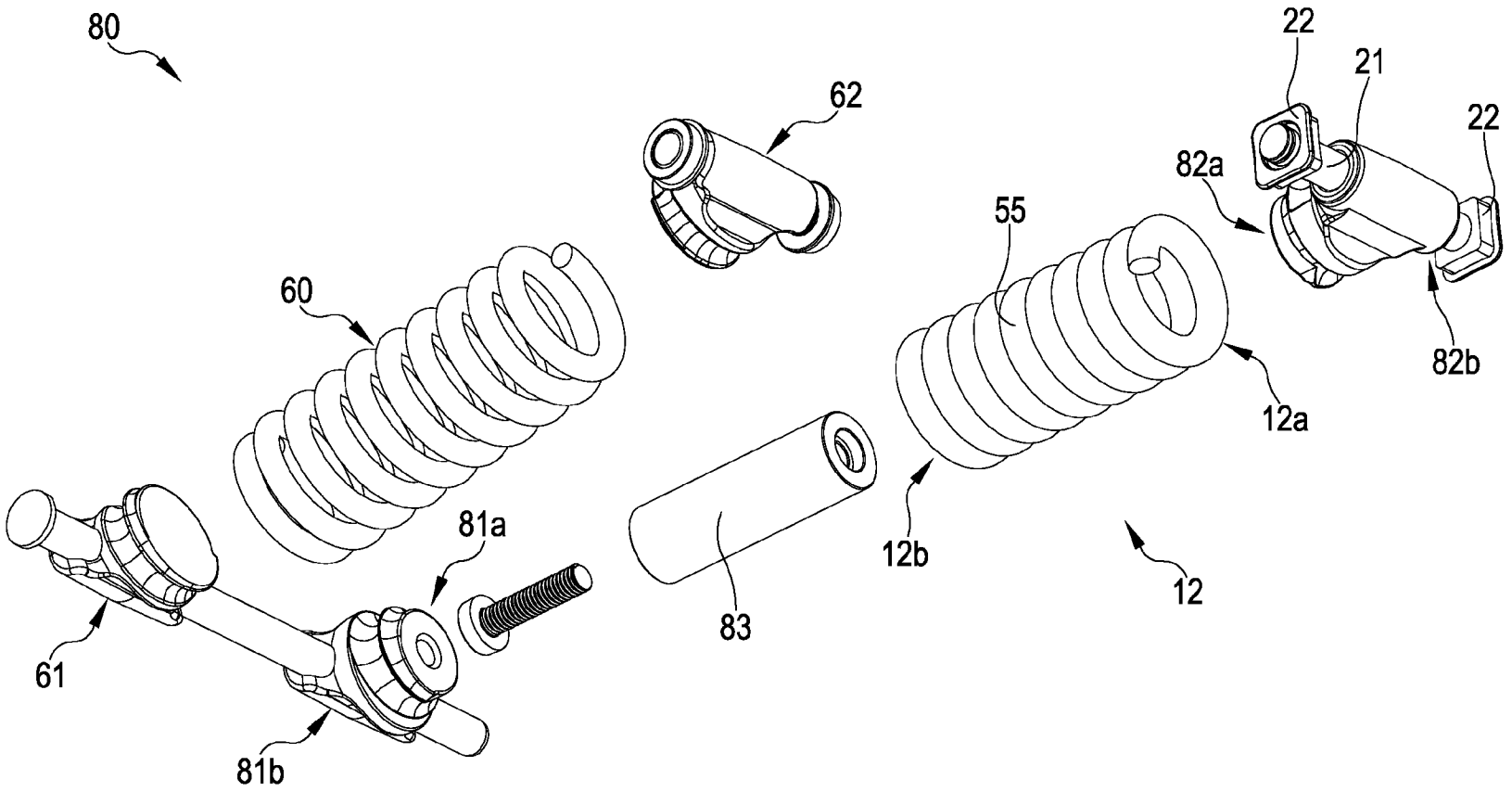
Figure 6:
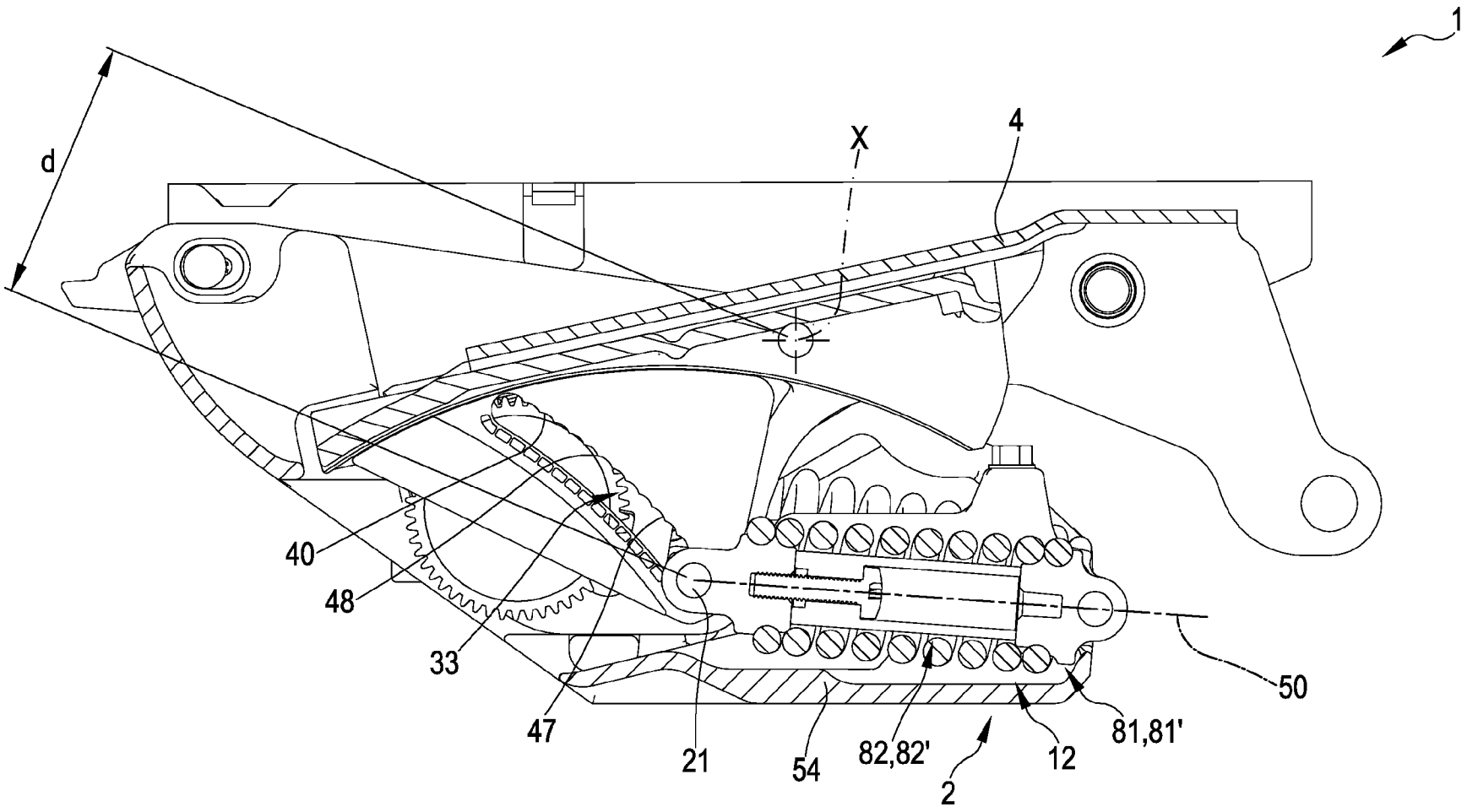
FIG. 6 is a longitudinal section of the embodiment of FIG. 1 along a section plane, in a first configuration and an at-rest state.

The elastic system 80 preferably comprises an additional elastic element 60 configured to contribute to the reaction moment. The additional elastic element is preferably configured so as to maintain, in the at-rest position, a residual elongation that generates an additional residual elastic force. Preferably, respective fastening ends of the additional elastic element are fastened to the frame 2 and to the structure 4 by means of respective fastening elements 61, 62. By way of example, the elastic element and the additional elastic element are both coil springs. Preferably, each fastening element 81', 82', 61 and 62 has a cylindrical external surface provided with a thread having a pitch compatible with the pitch of the coils, so that each fastening end of each spring is screwed externally to the respective cylindrical external surface of a respective fastening element (FIG. 5).

The mechanism preferably comprises a stop 90 fastened to the support frame 2 which acts as the lower stop abutment for the structure 4 at the at-rest position.

In use, when the mechanism is not subjected to tilting forces (FIG. 6), the structure is in the at-rest position and is preferably kept pushed against the support frame 2 by the additional elastic element 60, whereas the elastic element 12 does not exert any residual force between the frame 2 and the structure and between the frame and the adjustment system.

Figure 7:
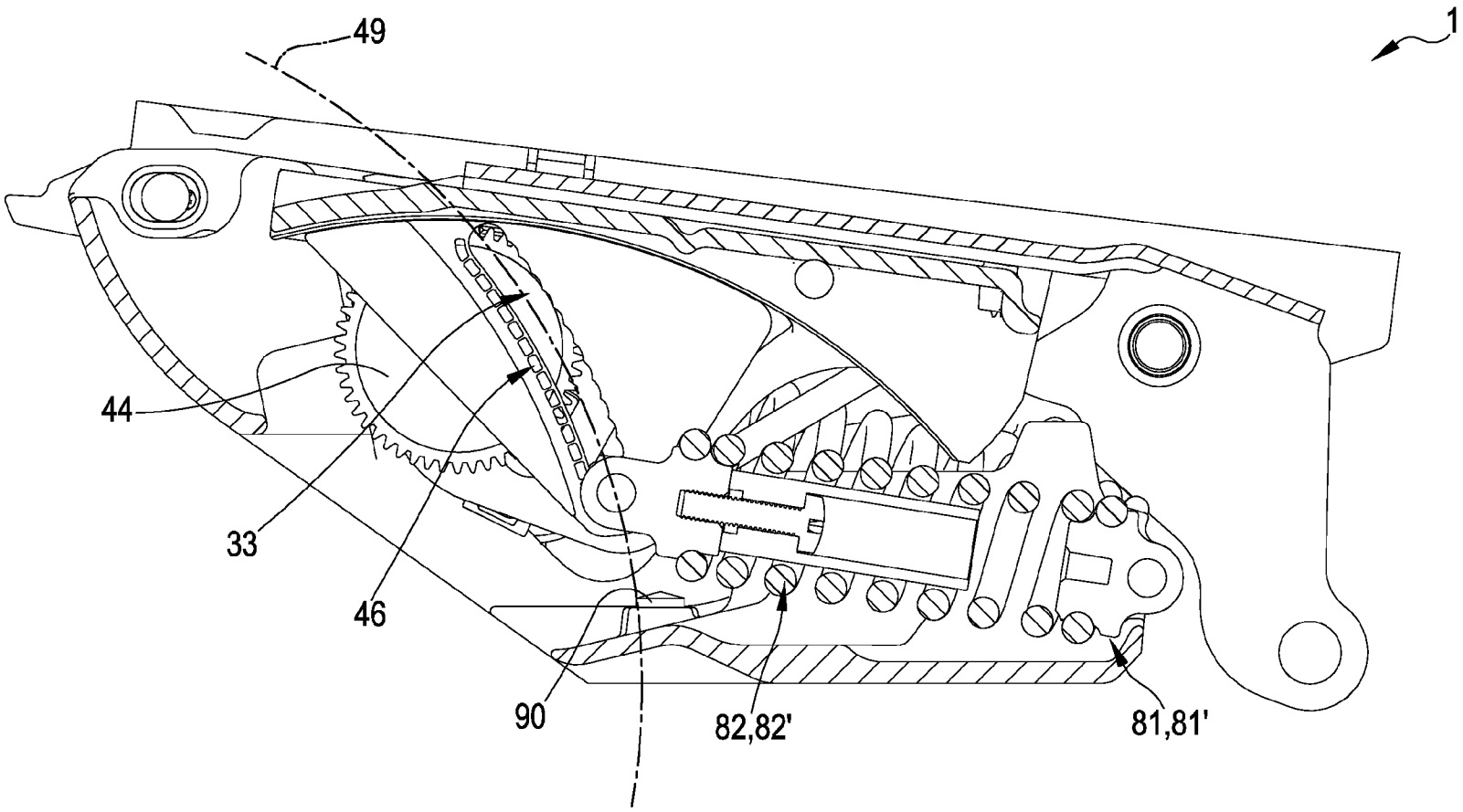
FIG. 7 is a section similar to that appearing in FIG. 6, in the first configuration and in a maximum tilting state.

It is assumed that the mechanism is in a first configuration (illustrated in FIG. 6) in which the distance d between the point of application (coinciding with the pin 21) of the reaction force of the elastic element 12 to the structure 4 and the first axis X is the maximum distance. In this configuration, the moment arm of the reaction force with respect to the first axis X is at a maximum and the moment of the reaction force generated by the elastic element 12 is at a maximum. Therefore, when the user exerts a tilting force on the structure 4, it receives a relatively high reaction moment (to which the additional elastic element 60, with a constant moment arm, and the elastic element 12, with a variable moment arm, contribute), which it must balance in order to tilt the structure (e.g. the backrest) in a given desired tilting position, as illustrated in FIG. 7 (maximum possible tilting position). The general sensation is thus that of a "hard" response.

In the at-rest position, when the user rotates the control rod 44 and thus the gear system 41, it causes the movement member 32 to slide along the guide 31 so that the inner surfaces of the first slots 33 push on the pin 21, forcing it to move (by increments corresponding to the seats 39 and 40) along the first slots 33, thus varying the distance d between the pin 21 and the first axis X until a second extreme configuration (unillustrated) is reached, in which the distance d is the minimum distance (minimum moment of the reaction force). In this configuration, when the user exerts a tilting force on the structure 4, it receives a relatively low reaction moment. The general sensation is thus that of a "soft" response.

Figure 8:
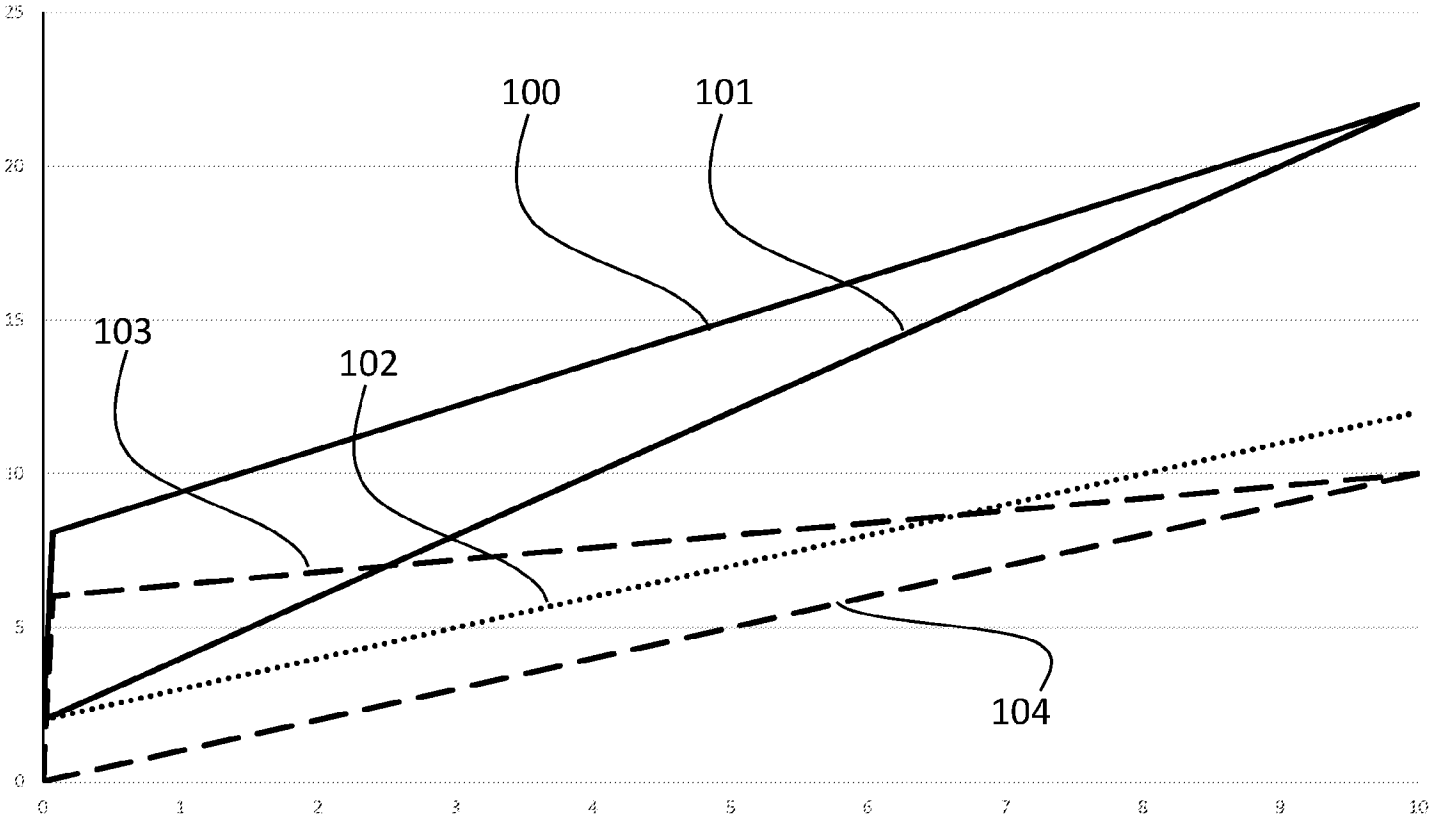
FIG. 8 is a purely schematic diagram illustrating possible advantages of the present invention.

In a purely schematic manner FIG. 8 illustrates several elastic response curves by way of example. The horizontal axis represents the tilting of the structure in arbitrary units (where 0 represents the at-rest position and 10 represents the maximum tilting position) and the vertical axis represents the reaction moment acting upon the structure 4 with respect to the axis X in a given configuration of hardness (equal for all curves in FIG. 8).

The curve 104 represents the elastic response of a comparative tilting mechanism with respect to the present invention, in which only one adjustable elastic element is present, in a completely undeformed and unloaded state in the at-rest position, and that develops an arbitrary value of 10 in the maximum tilting position. The disadvantage of this comparative solution consists in the poor stability of the mechanism in the at-rest position and markedly elevated dynamics of the response throughout the entire tilting range of 0 to 10.

The curve 103 represents the response of a tilting mechanism according to a first embodiment of the present invention in which the elastic system comprises a single adjustable elastic element 12 equipped with stop elements 81, 82. In the at-rest position, the elastic element does not develop a reaction moment, owing to the stop elements, although it has a residual elastic force equal to about 60% of the maximum elastic force.

As can be seen, although it develops the same maximum reaction moment as the comparative example 104, the dynamics throughout the tilting range are reduced, and in addition, for tilting positions near the at-rest position the moment developed proves to be relatively high, giving the mechanism greater stability.

In a second embodiment of the present invention, of the type described above with reference to FIGS. 1-6, the elastic system comprises an adjustable elastic element 12 (curve 103) and an additional fixed elastic element 60. The curve 102 represents the response of the additional elastic element, which in the at-rest position has a residual deformation and generates a corresponding residual reaction. The curve 100 represents the overall response of the elastic system according to the second embodiment of the present invention, as obtained from the sum of the curves 102 and 103.

In a comparative example with respect to the second embodiment of the present invention, the curve 101 represents the overall response of the elastic system, as obtained from the sum of the curves 102 and 104 described above. As can be seen, the dynamics throughout the entire tilting range are more elevated (from about 2 to about 22) with respect to the dynamics of the present invention (from about 8 to about 22).

The invention claimed is:

1. A tilting mechanism for chairs, comprising:

a support frame configured for being mounted on a stem of a chair, a structure coupled to said support frame so that said structure can rotate about a first axis, said structure being a support for a seat or a support for a backrest of the chair, an elastic system interposed between said support frame and said structure and configured to counteract a reaction to tilting of said structure about said first axis from an at-rest position, in absence of tilting forces, to a tilted position, said reaction generating a reaction moment acting upon said structure with respect to the first axis, wherein the elastic system comprises at least one elastic element having two fastening ends and a first stop element and a second stop element fastened at respective longitudinal end portions of said elastic element, respectively;

an adjustment system comprising a pin movably coupled to said structure and a movement system for moving said pin to vary a distance between said pin and said first axis for varying said reaction moment for a given tilting, wherein, during the tilting process, said elastic element generates an elastic reaction force which is transmitted to said structure by said pin;

wherein, in the at-rest position, said first and second stop elements are in contact with each other, and said elastic element is in an elongated deformed configuration and generates a residual elastic force which is at least partially released on the first and second stop elements, pushing the first and second stop elements against each other, and wherein the elastic system comprises an additional elastic element structured to contribute to said reaction moment, wherein said additional elastic element is configured to maintain, in said at-rest position, a respective elongated deformed configuration generating a further residual elastic force.

2. The tilting mechanism according to claim 1, wherein said residual elastic force is substantially completely released on the first and second stop elements.

3. The tilting mechanism according to claim 1, wherein said fastening ends are fastened to a first fastening element and a second fastening element, respectively, wherein the first fastening element is fastened to said support frame and the second fastening element is directly or indirectly fastened to said structure or to said adjustment system, and wherein each fastening element has a first portion at which a respective fastening end is fastened and a second portion, wherein the second portion of the first fastening element is fastened to said support frame and the second portion of the second fastening element is directly or indirectly fastened to said structure or to said adjustment system, and wherein said first and second stop elements are solidly constrained to said first and second fastening elements, respectively, coinciding with said first and second fastening elements.

4. The tilting mechanism according to claim 1, wherein in the at-rest position, the first and second stop elements are in contact with each other at portions thereof that are inside said elastic element and wherein at least one of the stop elements comprises a spacer on a side facing the other stop element.

5. The tilting mechanism according to claim 1, wherein said structure has a maximum tilting position beyond which said structure cannot tilt any further, wherein said elastic element exerts a maximum elastic force at said maximum tilting position and wherein said residual elastic force is greater than or equal to 5%, of said maximum elastic force.

6. The tilting mechanism according to claim 1, wherein said structure has a lower stop position in which the structure directly or indirectly abuts against said support frame and wherein at said lower stop position, said first and second stop elements are in contact with each other.

7. The tilting mechanism according to claim 1, wherein the elastic element or said additional elastic element is a coil spring and wherein each stop element has a cylindrical external surface provided with a thread having a pitch compatible with a respective pitch of said coils, wherein each longitudinal end portion, or each fastening end, of said elastic element is screwed externally to the respective cylindrical external surface of a respective stop element.

8. A chair comprising the tilting mechanism according to claim 1, a seat for a user and/or a backrest, and means for resting the chair on the ground and comprising a stem, wherein said support frame is rigidly mounted on said stem, and wherein said structure is solidly constrained to the seat and/or the backrest.

9. The tilting mechanism according to claim 1, wherein the movement system comprises a guide that is solidly constrained to the structure and a movement member that is slidably engaged in the guide, wherein the movement member engages the pin so that when the movement member slides in the guide, the movement member moves the pin.

10. The tilting mechanism according to claim 9, wherein the guide has a curvilinear or rectilinear development lying in a plane perpendicular to the first axis, and wherein the movement member has a pair of first slots that are symmetrically opposite each other, the pin passing through said first slots transversely to a respective principal plane of development of the first slots.

11. The tilting mechanism according to claim 1, further comprising two fastening elements for fastening two ends of the additional elastic element to said frame and to said structure, respectively, at fixed positions of respectively said frame and said structure, and wherein in the at-rest position, said fastening elements are not in contact with each other.

* * * * *